US007024810B2

(12) United States Patent
Kim

(10) Patent No.: US 7,024,810 B2
(45) Date of Patent: Apr. 11, 2006

(54) RETAIL DISPLAY ACCESSORY FOR AN ARTICLE OF CLOTHING TO ASSIST A CONSUMER IN SELECTING CLOTHING

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 177 days.

(21) Appl. No.: 10/623,104

(22) Filed: Jul. 18, 2003

(65) Prior Publication Data

US 2005/0016041 A1 Jan. 27, 2005

(51) Int. Cl.
*G09F 3/18* (2006.01)

(52) U.S. Cl. ..... 40/661.04; 40/672; 434/99; 434/400

(58) Field of Classification Search ..... 40/661.04, 40/672, 299.01; 434/99, 400
See application file for complete search history.

(56) References Cited

U.S. PATENT DOCUMENTS

| | | | | |
|---|---|---|---|---|
| 1,704,793 | A * | 3/1929 | Field | 434/99 |
| 1,718,919 | A * | 6/1929 | Fitzgibbon | 40/672 |
| 1,865,377 | A * | 6/1932 | Lewis | 434/400 |
| 3,040,448 | A * | 6/1962 | Paxton | 434/99 |
| 4,514,178 | A * | 4/1985 | Noto et al. | 434/395 |
| 4,909,632 | A * | 3/1990 | Simpson | 356/402 |

* cited by examiner

*Primary Examiner*—Gary C. Hoge
(74) *Attorney, Agent, or Firm*—Darby & Darby

(57) ABSTRACT

According to one exemplary embodiment, a retail display accessory is provided for assisting a consumer in color coordinating a first article of clothing (e.g., a tie) with a second article of clothing (e.g., a shirt). The accessory is in the form of an article having a front section and an opposing rear section with a slot being formed therebetween for receiving the first article of clothing. The front section has a first indicia section identifying a predominant color of the first article of clothing which is received in the slot and a second indicia section that identifies colors for the second article of clothing that are complementary to the color of the first article of clothing and produce a color coordinated outfit.

28 Claims, 4 Drawing Sheets

RETAIL DISPLAY ACCESSORY FOR AN ARTICLE OF CLOTHING TO ASSIST A CONSUMER IN SELECTING CLOTHING

TECHNICAL FIELD

The present invention relates to a retail display accessory and more particularly, to a retail display accessory for use with a first article of clothing, such as a tie, wherein the accessory includes an indicia section that provides a coordination scheme (e.g., a color coordination) to assist a consumer in purchasing a second article of clothing that is coordinated with the first article of clothing.

BACKGROUND

As the number of articles of clothing expands, the available colors and patterns of clothing articles are increasing and therefore it becomes ever more difficult to match one article of clothing for wear with a second article of clothing for wearing with the first article of clothing. Typically, the consumer who is looking to purchase one article of clothing makes the selection and purchase with an entire outfit in mind; however, most times the purchase of the article of clothing is made at a point of purchase without having the other items of clothing in front of the consumer to assist the consumer. For example, when purchasing a tie, it is common place and a traditional fashion rule that the color of the tie should be coordinated with the color of the underlying shirt so that the entire outfit is color coordinated. In other words, a tie with a predominant first color should be worn with a shirt that has a color that is coordinated with the first color and/or a pattern of a tie should be coordinated with a pattern of a shirt.

Because it is often a time consuming and frustrating task to select an article of clothing at a point of purchase while at the same time tying to select this article for wear in combination with other articles of clothing that are not present before the consumer, many potential customers simply choose not to shop or they let someone else shop for them. This results in a reduction in the potential customer base for the article of clothing since a number of customers have forsaken shopping to avoid the task of purchasing an article of clothing that is color coordinated with other articles of clothing not before the customer. Other individuals are simply not fashionably enough aware such things as color coordinating outfits and matching colors and patterns and therefore, these individuals often times mix and match clothing articles that are ideally not met for one another or they otherwise clash in some way.

What has heretofore not been available is a retail display accessory for an article of clothing which assists a consumer in selecting an article of clothing that is color coordinated or otherwise coordinated with other articles of clothing, thereby expanding the customer base that is comfortable making a selection and purchasing the article of clothing.

SUMMARY

According to one exemplary embodiment, a retail display accessory is provided for assisting a consumer in color coordinating a first article of clothing (e.g., a tie) with a second article of clothing (e.g., a shirt). The accessory is in the form of an article having a front section and an opposing rear section with a slot being formed therebetween for receiving the first article of clothing. The front section has a first indicia section identifying a predominant color of the first article of clothing which is received in the slot and a second indicia section that identifies colors for the second article of clothing that are complementary to the color of the first article of clothing and produce a color coordinated outfit consisting of at least the first and second articles of clothing.

Preferably, the article includes a tab that extends outward from a body section and includes the first indicia section that indicates the predominant color of the first article of clothing. The indicia for each of the complementary colors represents a predominant color of the second article of clothing and in one embodiment, the second indicia section includes a plurality of color indicators, each color indicator representing one color that is complementary to the predominant color of the first article of clothing. For example, each color indicator can be in the form of a bounded area that contains one printed color therein to indicate to the consumer a complementary color relative to the predominant color of the first article of clothing.

The present retail display accessory thus assists a consumer in selecting an article of clothing that is color coordinated with other articles of clothing, thereby expanding the customer base that is comfortable making a selection and purchasing the article of clothing.

Further aspects and features of the exemplary actuator and method of manufacture thereof can be appreciated from the appended Figures and accompanying written description.

BRIEF DESCRIPTION OF THE DRAWING FIGURES

DETAILED DESCRIPTION OF PREFERRED EMBODIMENTS

Figure 1:
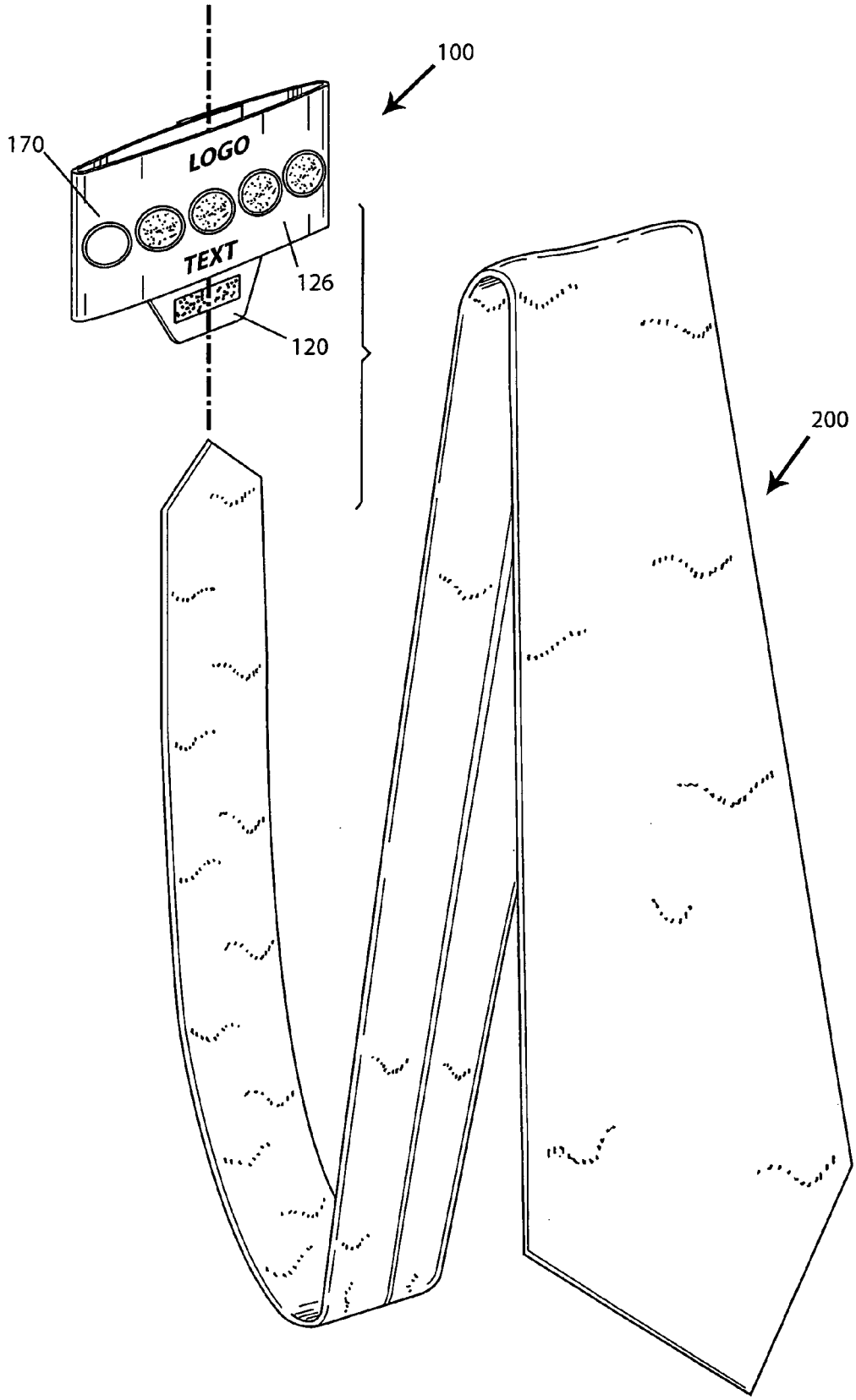
FIG. 1 is a front perspective view of one exemplary retail display accessory according to one exemplary embodiment in relation to an article of clothing.
Figure 2:
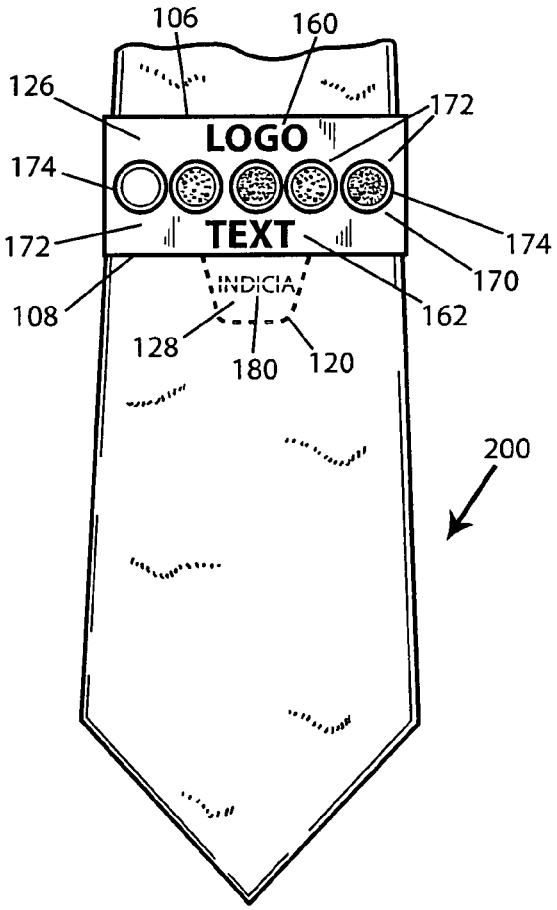
FIG. 2 is a front elevational view of the retail display accessory of FIG. 1 relative to a front face of the article of clothing.
Figure 3:
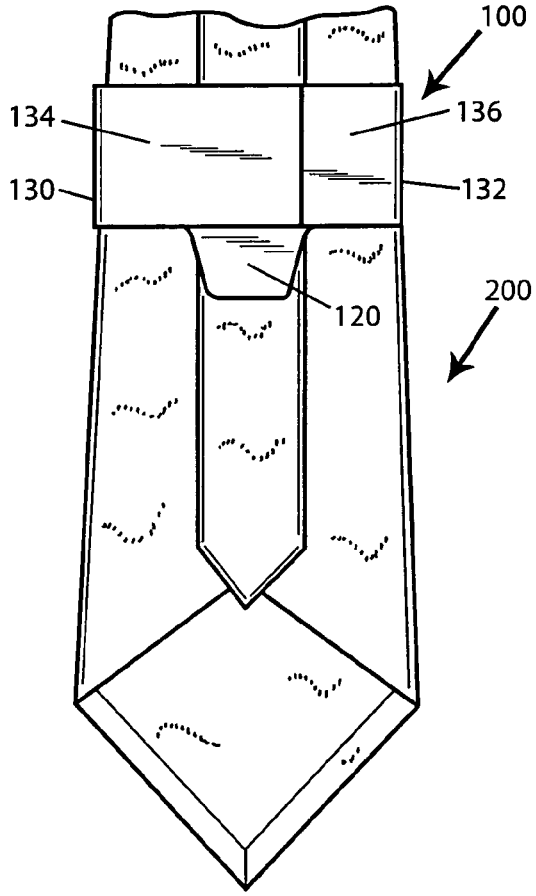
FIG. 3 is a rear elevational view of the retain display accessory of FIG. 1 relative to a rear face of the article of clothing.

Referring to FIGS. 1–4, FIG. 1 is a front perspective view of one exemplary retail display accessory 100 shown in combination with an article of clothing 200 with which the retail display accessory 100 is intended for use with. In a first embodiment, the retail display accessory 100 is intended for use as a display accessory that receives one tie 200 as illustrated in FIG. 1. The retail display accessory 100 can be formed from a number of different materials with one preferred material being a paper based material (heavy backed paper or cardboard).

Figure 4:
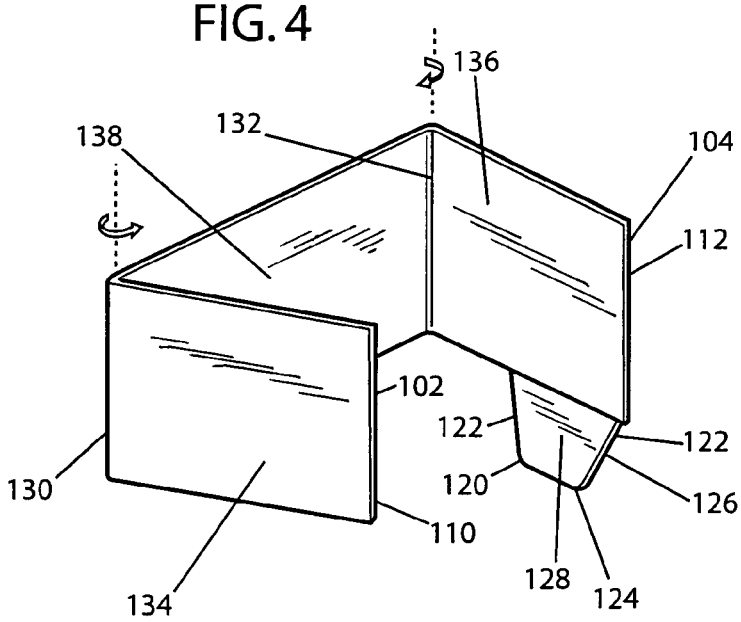
FIG. 4 is a perspective view of a blank used to construct the accessory of FIG. 1.

As best shown in FIG. 4, the illustrated retail display accessory 100 is constructed by forming a blank 101 from a sheet of a paper based material. For example, the blank 101 is cut from the sheet according to a desired pattern. The blank 101 is an elongated structure that has a first end 102 and an opposing second end 104. In one exemplary embodiment, the blank 101 is cut to have a generally rectangular shape with parallel top and bottom edges 106, 108 and end edges 110, 112 at the ends 102, 104. At one of the ends 102, 104 (e.g., the second end 104), a tab 120 is formed and extends down from the bottom edge 108. The tab 120 has a tapered construction in that it is formed of first and second beveled sides 122 and a lower edge 124 that is parallel to the bottom edge 108. The blank 101 has a first face 126 and an opposing second face 128. One of the beveled sides 122 terminates at the end edge 112.

To construct the retail display accessory 100, first and second fold lines 130, 132 are formed in the blank 101 to divide the blank 101 into first and second end sections 134, 136 and an intermediate section 138 therebetween. The tab 120 is formed as a part of the second end section 136. The first end section 134 is folded inward along the first fold line 130 so that the second face 128 of the first end section 134 faces the second face 128 of the intermediate section 138. The second end section 136 is also folded inward along the second fold line 132 so that the second face 128 of the second end section 136 faces both a portion of second face 128 of the intermediate section 138 and another portion of the second face 128 (including the end edge 112) faces the first face 126 of the first end section 134.

The second end section 136 is adhered to the first end section 134 to form a continuous endless body section 110. The two end sections 134, 136 are adhered using conventional techniques, such as using a glue or other type of adhesive material or by using another technique, such as a staple. When the first and second end sections 134, 136 are adhered, the second face 128 of the tab 120 is visible below the opposite first face 126 of the intermediate section 138 which is likewise visible.

The fold lines 130, 132 are preferably creased lines and in a rest position, the intermediate section 138 and the joined first and second end sections 134, 136 slightly bow outward so that a space is formed between the intermediate section 138 and the joined first and second end sections 134, 136. Because of the flexible, bendable nature of the body section 110, the user can easily hold the body section 110 along the first and second fold lines 130, 132 and apply an inward force thereto which causes the intermediate section 138 and first and second end sections 134, 136 to separate even further from one another.

The first face 126 can have a first color and the second face 128 can have a second different color or have no color (e.g., white). For example, the first face 126 which is visible to the consumer can be an eye catching color or can be decoratively patterned to attract attention. In one embodiment, the first face 126 has a black color and the second face 128 is colored white. Preferably, the first face 126 of the intermediate section 138 has a first indicia section 160 for placing a corporate identifier or logo or the trade name of the product. The first indicia section 160 is preferably formed along the top edge 106 of the intermediate section 138. A second indicia section 162 is likewise preferably formed along the bottom edge 108 of the intermediate section 138 for containing additional information that identifies the accessory 100 and/or provides instruction to the consumer. Between the first and second indicia sections 160, 162 a first coordination indicia area 170 is formed which functions as described in greater detail below. A second complementary coordination indicia area 180 is formed on the second face 128 of the tab 120.

In one exemplary embodiment, the accessory 100 is for assisting the consumer in color coordinating an outfit which includes the article of clothing 200 which is contained within the accessory 100. The second coordination indicia area 180 represents the area in which a predominant characteristic of the article of clothing 200 is indicated and it is this predominant characteristic with which the consumer desires to coordinate with another article of clothing. For example, the predominant characteristic is preferably the predominant color of the article of clothing 200. In the case of a tie, the predominant color of the tie is the color that covers the greatest surface area of the tie and typically, this color covers at least 50% of the surface area of the tie. The predominant characteristic can be portrayed in the second coordination indicia area 180 in a number of different ways. For example, text in the name of a particular color can be written across the area 180 or alternatively, a swash or printed segment that represents the color can be disposed in the area 180. In other words, if the predominant color of the tie is red, the word "red" can be written across the area 180 (as illustrated) or a red color can added to the area 180 to identify that this particular accessory 100 is intended for use with a red tie.

Figure 5:
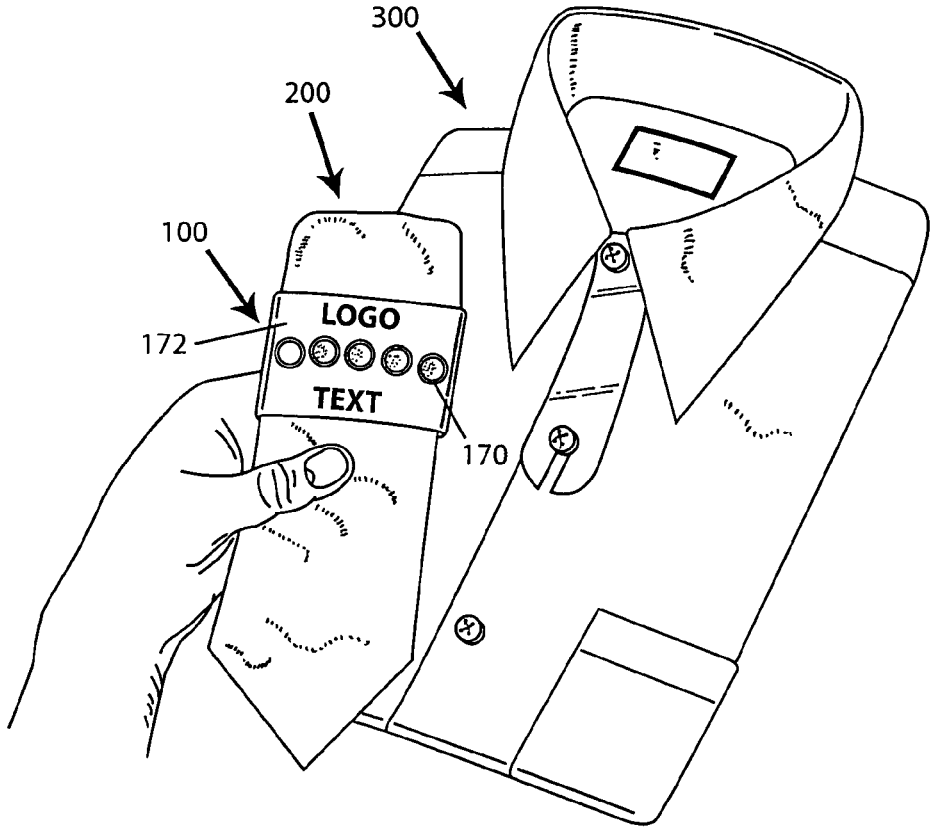
FIG. 5 is a front perspective view of the accessory carried by the first article of clothing as well as a second article of clothing being illustrated for matching with the first article of clothing.

As best shown in FIG. 5, the accessory 100 is therefore intended to assist the consumer in selecting a second article of clothing 300 that is particularly suited for wear with the first article of clothing 200. In other words, once the consumer selects the first article of clothing 200, the consumer then views the accessory 100 which provides guidance as to the selection of the second article of clothing 300 which is intended for use in combination with the first article of clothing 200. For example, when the first article of clothing 200 is a tie, the second article of clothing 300 is a shirt or the like which is to be worn with tie 200. As one will appreciate, the selection of a tie and a shirt is done with a view as to how the two will look together and it is desirable for the color scheme of the tie to be complementary to the color scheme of the shirt. In other words, it is desirable for the predominant color of the tie to be matched with the predominant color of the shirt such that the two are complementary to one another.

As will be appreciated from FIG. 5, the consumer can easily select one tie 100 with the accessory 100 thereon and then carry both over to one shirt 300 after having observed the information in the first coordination indicia area 170. The consumer is guided by the information in the indicia area 170 and then can use this information to select a matching shirt 300. The consumer can compare the complementary colors shown in the area 170 with the color of one or more shirts until a match is made and the consumer is satisfied.

Referring to FIGS. 1–5, the first coordination indicia area 170 includes a plurality of distinct indicators 172 that each contains a distinct color that represents a color which is suitable for paring with the color that is indicated in the second coordination indicia area 180. For example, the colors that are indicated in the first coordination indicia area 170 are determined to be suitable for combination with the color indicated in the second coordination indicia area 180. The distinct indicators 172 can be represented in a number of different ways so long as the individual colors are separated from one another so that the consumer can tell clearly tell how many and which colors are being indicated as producing a desired color coordinated match with the color indicated in the second coordination indicia area 180. In one embodiment, the indicators 172 are printed colors that are contained within a boundary 174 that can have any number of different shapes. For example, the boundary 174 can be in the form of a ring that outlines a circle which is printed in a particular matching color, as illustrated. It will be appreciated that the indicators 172 are not limited to being circular in shape but can have any number of other shapes, such as a square, oval, oblong, triangular or some other regular or irregular shape.

When the first and second coordination indicia areas 170, 180 areas are for indicating colors that are suitable for combination (e.g., color coordination of the first article of clothing 200 with the second article of clothing 300), the below table is illustrative of the various color schemes that are preferred and are printed on the accessory 100.

TABLE 1

| Predominant Color of the First Article of Clothing (e.g., a tie) | Predominant Colors of the Second Article of Clothing (e.g., a shirt) that are color coordinated with the color of the First Article of Clothing |
|---|---|
| Red | White, ivory, silver, blue, and black |
| Blue | White, gray, blue, silver and black |
| Taupe | White, silver, cream, black and ivory |
| Olive | White, ivory, olive, cream, and black |
| Yellow | White, blue, cream, silver, and ivory |
| Burgundy | White, burgundy, silver, mustard (gold), ivory and black |

It will be appreciated that the accessory is not limited to assisting in coordination of the above listed colors which are merely exemplary in nature and not limiting. In other words, the first article of clothing can have any number of other colors, such as black, pink, purple, black, and the second article of clothing will then have a complementary color compared to the color of the first article of clothing to produce a color coordinated outfit. Moreover, the coordination scheme of the present accessory is not limited only to coordination of colors but rather can be applied to coordination of prints or patterns of the first article of clothing. For example, the first indicia section can display a predominant pattern of the first article of clothing and then the second indicia section can indicate patterns for the second article of clothing that are complementary to the pattern in the first indicia section. For example, if the first article of clothing has stripes, it is a typical rule that the second article of clothing should not contain a striped pattern but rather should be a solid color or the like and vice versa. Also, some pastel patterns match better with other clothing patterns.

It will also be understood that the accessory 100 is not limited only to being used with tie 200 for assisting the consumer in selecting a complementary shirt 300 but rather, the accessory 100 has a broader application in that it is used for identifying complementary characteristics of two articles, e.g., two articles of clothing, so as to assist and guide the consumer at a point of purchase.

Figure 6:
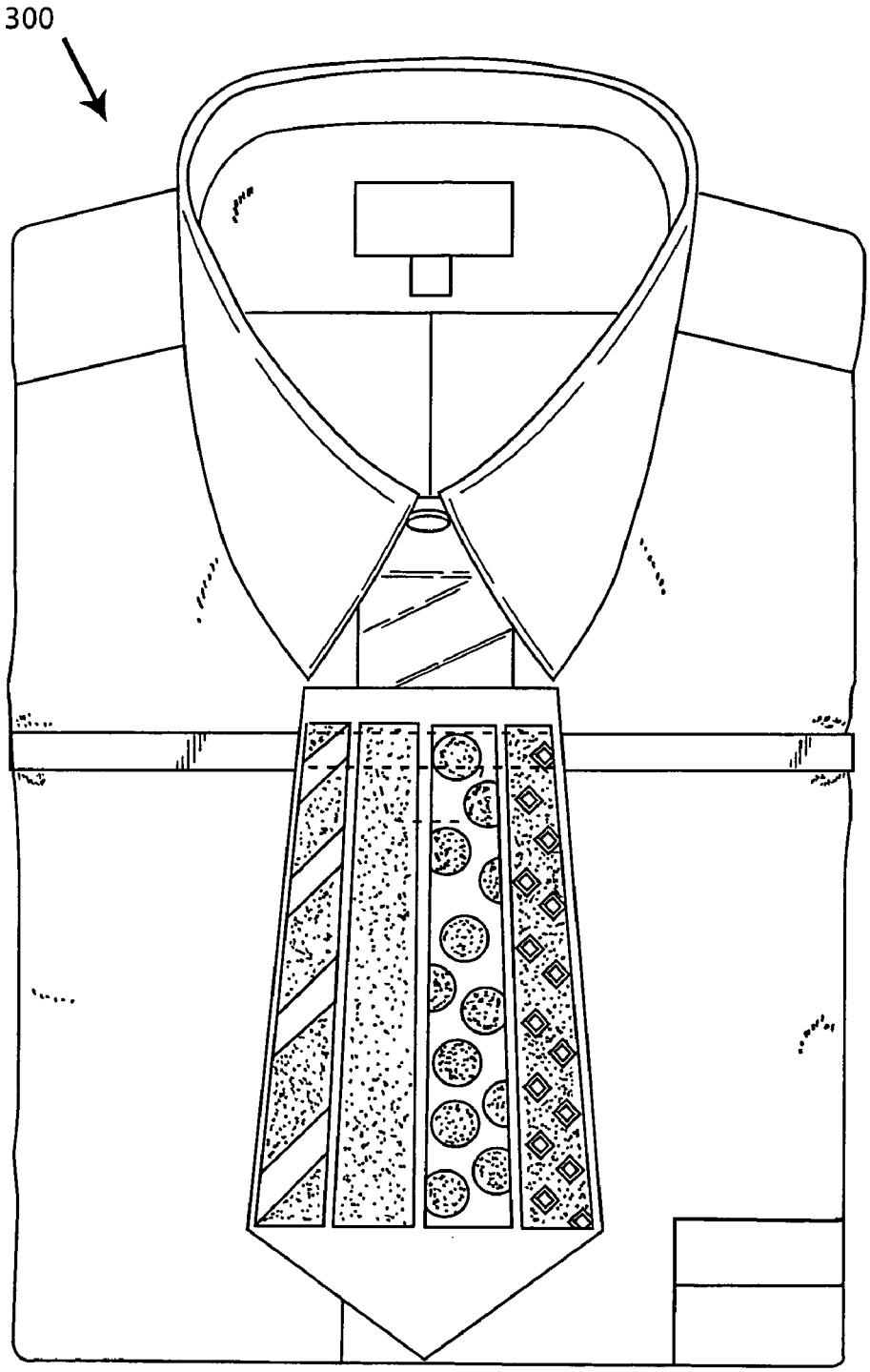
FIG. 6 is a front perspective view of a retail display accessory according to a second embodiment.

For example, the reverse is true in that the accessory 100 can be attached around a shirt and the first coordination indicia area 170 can be used to identify colors of ties that are complementary to the color of the shirt on which the accessory 100 is attached as illustrated in FIG. 6. For example, in FIG. 6, the accessory 100 includes an indicia area that lists a number of different tie patterns and/or colors and patterns that are complementary to the shirt 300 on which the accessory 100 is coupled to. This aides the consumer in selecting a tie that will be complementary to the shirt 300.

Moreover, the accessory 100 can be used to help a consumer match a suit color with a shirt or vice versa and in other embodiment, the accessory 100 can facilitate the selection of a tie that is complementary to a particular suit color or pattern.

It will be appreciated by persons skilled in the art that the present invention is not limited to the embodiments described thus far with reference to the accompanying drawings; rather the present invention is limited only by the following claims.

What is claimed is:

1. A retail display accessory for assisting a consumer in color coordinating a first article of clothing with a second article of clothing, the accessory comprising:

a body section that is constructed to be carried by the first article of clothing, the body section having a first indicia section identifying a predominant color of the first article of clothing and a second indicia section that identifies colors for the second article of clothing that are complementary to the color of the first article of clothing, wherein the predominant color is represented by a printed swash of color in the first indicia section to permit easy identification of which first article of clothing is intended for use with the retail display accessory and permit the colors in the second indicia section to be selected specifically in view of the color of the printed swash.

2. A retail display accessory for assisting a consumer in color coordinating a first article of clothing with a second article of clothing, the accessory comprising:

a body section that is constructed to be carried by the first article of clothing, the body section having a first indicia section identifying a predominant color of the first article of clothing and a second indicia section that identifies colors for the second article of clothing that are complementary to the color of the first article of clothing, wherein the body section includes a tab that extends outwardly from a base section with the first indicia section being formed on one face of the tab.

3. The retail display accessory of claim 2, wherein the first article of clothing is a tie and the second article of clothing is a shirt.

4. The retail display accessory of claim 2, wherein the body section is formed of a paper material and includes a space formed between a front section and a rear section which receives the first article of clothing so that the body section is disposed around a portion of the first article of clothing.

5. The retail display accessory of claim 2, wherein the second indicia section is formed on one face of the base section.

6. The retail display accessory of claim 2, wherein the body section is formed of a blank that includes two fold lines that partition the blank into two end sections and an intermediate section formed therebetween.

7. The retail display accessory of claim 6, wherein the blank is folded along the two fold lines so that one end of one end section is brought into contact with one face of the other end section.

8. The retail display accessory of claim 7, wherein the one end section is adhered to the other end section with a glue material.

9. The retail display accessory of claim 6, wherein the body section includes a top edge and an opposing lower edge with a tab extending outwardly from one of the top edge and the bottom edge, the first indicia section being formed on one face of the tab.

10. The retail display accessory of claim 2, wherein indicia for each of the complementary colors represents a predominant color of the second article of clothing.

11. The retail display accessory of claim 2, wherein the second indicia section includes a plurality of color indicators, each color indicator representing one color that is complementary to the predominant color of the first article of clothing.

12. The retail display accessory of claim 11, wherein the color indicator is a bounded area that contains one printed color therein.

13. The retail display accessory of claim 2, wherein the predominant color of the first article of clothing is red and the complementary colors displayed in the second indicia section are two or more colors selected from the group consisting of white, ivory, silver, blue, and black.

14. The retail display accessory of claim 2, wherein the predominant color of the first article of clothing is blue and the complementary colors displayed in the second indicia section are two or more colors selected from the group consisting of white, gray, blue, silver and black.

15. The retail display accessory of claim 2, wherein the predominant color of the first article of clothing is taupe and the complementary colors displayed in the second indicia section are two or more colors selected from the group consisting of white, silver, cream, black and ivory.

16. The retail display accessory of claim 2, wherein the predominant color of the first article of clothing is olive and the complementary colors displayed in the second indicia section are two or more colors selected from the group consisting of white, ivory, olive, cream, and black.

17. The retail display accessory of claim 2, wherein the predominant color of the first article of clothing is yellow and the complementary colors displayed in the second indicia section are two or more colors selected from the group consisting of white, blue, cream, silver, and ivory.

18. The retail display accessory of claim 2, wherein the predominant color of the first article of clothing is burgundy and the complementary colors displayed in the second indicia section are two or more colors selected from the group consisting of white, burgundy, silver, mustard/gold, ivory and black.

19. A retail display accessory for assisting a consumer in color coordinating a first article of clothing with a second article of clothing, the accessory comprising:

a body section that is constructed to be carried by the first article of clothing, the body section having a first indicia section identifying a predominant color of the first article of clothing and a second indicia section that identifies colors for the second article of clothing that are complementary to the color of the first article of clothing, wherein the predominant color of the first article of clothing is identified by text written in the first indicia section.

20. A method for assisting a consumer in selecting a coordinating outfit formed of first and second articles of clothing, the method comprising the steps of:

providing a retail display accessory;

associating the retail display accessory with the first article of clothing that has a predominant color;

representing the predominant color by printing a swash of color in a first section of a front face of the retail display accessory to permit easy identification of which first article of clothing is intended for use with the retail display accessory; and printing a plurality of color indicators in a second section of the front face of the retail display accessory, the plurality of color indicators identifying colors for the second article of clothing that are complementary to the predominant color of the first article of clothing, wherein the swash of color in the first section of the front face of the retail display accessory permits the plurality of color indicators in the second section of the front face of the retail display accessory to be selected specifically in view of the color of the printed swash.

21. The method of claim 20, wherein associating the retail display accessory with the first article of clothing comprises the step of:

inserting the first article of clothing through a slot formed between a front section and a back section of the accessory which is in the form of an article that is carried by the first article of clothing.

22. The method of claim 20, wherein the retail accessory is a holder article which is constructed by:

providing a blank that includes two fold lines that partitions the blank into two end sections and an intermediate section formed therebetween;

folding the blank along the two fold lines so that one end of one end section is brought into contact with one face of the other end section; and fixing one end section to the other end section so that a slot is formed between the intermediate section and the joined end sections for receiving the first article of clothing therethrough.

23. The method of claim 20, wherein the step of printing the plurality of color indicators comprises the step of:

printing indicia representing a plurality of complementary colors along the second section of the front face of the retail display accessory.

24. The method of claim 23, wherein the indicia is a bounded color region for each color.

25. A method for assisting a consumer in selecting a coordinating outfit formed of first and second articles of clothing, the method comprising the steps of:

providing a retail display accessory;

associating the retail display accessory with the first article of clothing that has a predominant color;

listing a plurality of color indicators on one section of the front face of the retail display accessory, the plurality of color indicators identifying colors for the second article of clothing that are complementary to the predominant color of the first article of clothing and produce the color coordinated outfit; and forming a tab that extends away from a body section of the accessory, the tab having indicia formed thereon that represents the predominant color of the first article of clothing.

26. The method of claim 25, wherein the indicia on the tab is text.

27. A retail display accessory for assisting a consumer in color coordinating a first article of clothing with a second article of clothing, the accessory comprising:

an article that is constructed to be carried by the first article of clothing, the article being formed from a blank that includes two fold lines that partitions the blank into two end sections and an intermediate section formed therebetween, the blank being folded along the two fold lines so that one end of one end section is brought into contact with one face of the other end section and one end section is fixed to the other end section so that a slot is formed between the intermediate section and the joined end sections for receiving the first article of clothing therethrough, the blank having a front surface and an rear second surface, the front surface including a first indicia section identifying a first characteristic of the first article of clothing, the rear surface including a portion that has a second indicia section that identifies second characteristics for the second article of clothing that are complementary to the first characteristic of the first article of clothing.

28. The accessory of claim 27, wherein the first characteristic comprises a predominant color of the first article of clothing and the second characteristics comprise complementary colors that result in color coordination between the first and second articles of clothing.

* * * * *